US006119649A

United States Patent [19]

Raab

[11] Patent Number: 6,119,649

[45] Date of Patent: Sep. 19, 2000

[54] ROTATING PISTON ENGINE

[76] Inventor: Anton Raab, Riegerhofweg 1, D-80686 Munich, Germany

[21] Appl. No.: 08/875,165

[22] PCT Filed: Jan. 18, 1996

[86] PCT No.: PCT/EP96/00193

§ 371 Date: Jul. 18, 1997

§ 102(e) Date: Jul. 18, 1997

[87] PCT Pub. No.: WO96/22453

PCT Pub. Date: Jul. 25, 1996

[30] Foreign Application Priority Data

Jan. 19, 1995 [DE] Germany ..... 195 01 418
Jun. 13, 1995 [DE] Germany ..... 195 21 528

[51] Int. Cl.[7] ..... F02B 53/00

[52] U.S. Cl. ..... 123/233; 418/224; 418/226

[58] Field of Search ..... 123/228, 233; 418/141, 224, 226

[56] References Cited

U.S. PATENT DOCUMENTS

| | | | |
|---|---|---|---|
| 1,101,794 | 6/1914 | Friend | 123/203 |
| 1,960,971 | 5/1934 | Fisher | 123/233 |
| 2,779,318 | 1/1957 | Strader | 123/233 |
| 4,003,348 | 1/1977 | Suzuki et al. | 123/233 |

FOREIGN PATENT DOCUMENTS

| | | | |
|---|---|---|---|
| 280570 | 7/1990 | German Dem. Rep. | 418/141 |
| 3825365 | 2/1990 | Germany . | |
| 4112058 | 10/1992 | Germany . | |
| 4200146 | 6/1993 | Germany . | |

*Primary Examiner*—Michael Koczo
*Attorney, Agent, or Firm*—Antonelli, Terry, Stout & Kraus, LLP

[57] ABSTRACT

An engine with one or more ring cylinders of round cross-section is disclosed. In each ring cylinder are provided at least two rotary pistons whose cross-sections match that of the ring cylinder, the pistons being mounted on the circumference of a rotary disc which is mounted on a shaft and incapable of rotating. Each cylinder is provided with disc cams in the form of rotary valves which protrude at their peripheral areas through slots which extend transversely in relation to the course of the ring cylinders. Rotary valves engage in overflow channels and in the ring cylinder between an intake compression chamber and an expansion chamber. The rotary valves engage in the ring cylinder between an expansion chamber and an intake compression chamber. The rotary valve grooves are so arranged as to clear the ring cylinder for the rotary pistons. The rotary valve recesses are so arranged as to clear the overflow channels immediately before or during closure of the aperture and during closure of the aperture by the rotary pistons.

25 Claims, 13 Drawing Sheets

ROTATING PISTON ENGINE

TECHNICAL FIELD

This invention relates to an engine with one or more annular cylinders with round cross section, in each annular cylinder there being at least two rotating pistons with cross sections which correspond to the cross sections of their annular cylinder.

It is a rotating piston machine, with annular cylinders and pistons which rotate therein, with rotary valves as shut-off parts and stationary working walls.

The invention is an internal combustion engine which belongs in the domain of rotating machinery. In it the energy is used directly to produce rotation without the intermediary of pulsating movements. In versions of the invention integrated use of cylinder walls as hydraulic and/or pneumatic pumps is possible.

BACKGROUND AND SUMMARY

A rotating piston machine is known (DE-38 25 354 A1) which is made with rotary valves which have the same rpm and thus necessarily a diameter roughly the same as the annular cylinders. The rotary valve fits from the outside into the annular cylinder, by which the box dimension roughly corresponds to twice that of the annular cylinder or the rotor disk diameter. The fresh gas flows are deflected by 180 degrees in front of the piston in order to be able to initiate ignition and expansion behind the piston.

Conversely, the object of this invention is to devise a rotating piston machine with rotating pistons in which the gas flows need not be deflected, so that pulsating motion is avoided.

The engine according to the invention contains one or more annular cylinders with a round cross section which is preferably circular. In the annular cylinder are at least two rotating pistons with a cross section which is matched to the cross section of the annular cylinders which are located on the periphery of a rotor disk, preferably at the same angle to one another. The annular cylinder is divided by disk cams which are made as rotary valves into several cylinder chambers, of which at least one is an expansion chamber. At least one other cylinder chamber can be an intake compression chamber.

Instead of an intake compression chamber, there can also be an external compressor which routes the gas mixture directly from the outside into the expansion chamber. In doing so, in front of and behind the piston or pistons only the working steps which are carried out in the expansion chamber can take place. The compressor handles intake and compression. In addition, there can be cylinder chambers as hydraulic and/or pneumatic pumps. In the embodiment with the intake compression chambers each expansion chamber contains at least one overflow channel which discharges with its one port into an intake compression chamber and with the other port into the expansion chamber. The expansion chamber furthermore contains at least one exhaust channel, the intake compression chamber at least one air intake channel.

In the embodiment with the intake compression chambers the overflow channel is arranged such that with one of the rotary valves via one control recess the gas column in the overflow channel and with another control recess the piston passage between the intake compression chamber and the cylinder chambers can be controlled.

One air intake channel discharges into one cylinder recess in the intake compression chamber, the exhaust channel discharges in the expansion chamber via a cylinder recess.

Compared to known rotating piston machinery, the engine according to the invention has fewer wearing parts and thus lower friction losses. It does not require internal oil lubrication between the inside wall of the cylinder and the outside wall of the piston since it is unnecessary to use piston rings. Gaskets where the rotor disks fit into the cylinder wall and gaskets on the rotary valves can generally be abandoned.

The gas flows always maintain the same direction in both compression and expansion. In the embodiment with intake compression chambers, when the pistons move from the intake compression chamber into the expansion chamber the fresh gas is retained in the overflow channel until the piston has moved from the intake compression chamber into the expansion chamber and is then ignited in the expansion chamber behind the receding piston. Thus cylinder flushing and gas exchange can be almost 100%; in none of the existing internal combustion engines with closed compression spaces was this possible. Because the gas flows always move in the direction of rotation and the pistons likewise divide the cylinder walls in the direction of rotation, at the same time one working step is completed in front of and behind the piston, in the intake compression chamber at the same time fresh gas being aspirated behind the piston and fresh gas being compressed in front of the piston, while in the expansion chamber at the same time ignition takes place behind the piston and the gas is expanded and expelled and residual gases burned in front of the piston are ejected by the preceding stroke. This enables optimum cylinder flushing.

In the engine according to the invention much shorter pistons are possible than in engines of the prior art, for example in DE-38 25 354 A1. Thus it is possible to provide shorter control recesses in the rotary valves, with which shorter opening and closing times of the rotary valves are connected. The rotary valves can rotate with higher rpm than the rotor disk, for example with twice the speed, and they can then have a smaller diameter. If in addition two rotary valves which turn in opposite directions and which lie parallel on top of one another are used as rotary valve pairs, the opening and closing times of the control recesses can again be cut in half.

If the number of pistons and cylinder chambers are increased while the cylinder volume remains the same, the power density increases at the same time, as does the smoothness of running, since the expansion thrusts increase and are distributed more uniformly in the annular cylinder. The number of expansion chambers times the number of pistons corresponds to the number of expansion strokes (equal to the working strokes) when the rotor disk turns 360 degrees.

If an engine version with two or more cylinder chambers is used, the cylinder chambers which are not needed for the ICE can be used as assemblies for producing hydraulic and/or pneumatic pressure and/or suction or vacuum. Likewise the rotor disks or pistons can be driven in the direction of rotation if the hydraulically and/or pneumatically used cylinder chambers receive the corresponding pressurized medium from the outside via the intake channel, for example, as a starter for the starting phase.

In the engine according to the invention, grinding seal rings and/or piston rings can be largely abandoned. Since no component of the engine executes rotary motion, damaging mass forces can be avoided. Rotation occurs in only one direction. Mushroom valves with hammering stress of valves and valve seats which at the same time prevent unhindered gas flow need not be used.

Thermodynamics at least equivalent to the straight cylinder space of the reciprocating piston prevails in the bent cylinder space of the annular cylinder.

Inherent sealing elements are unnecessary. If they are used at all, preferably materials with very hard surface structure and low coefficients of expansion, for example teflon or ceramic, are used. To seal the pistons to the inside wall of the cylinder, so-called gas pressure labyrinth seal lubrication is used. Here the high combustion pressure which can exceed 200 bar is used through the corresponding holes and routed areas in the piston in order to press a small part of the burning gas mixture between the inside wall of the cylinder and the piston. In doing so air cushions are formed which are used both as lubrication and also to minimize gas loss on the pistons. For most applications however a seal with a very small gap between the piston and inside wall of the cylinder is enough.

By means of the pressure of the combustion gases and/or the compressed fresh gases different engine bearings can be made as aerodynamic bearings. In particular, the rotor disks where they fit into the annular cylinder wall, the rotary valves to the housing, and for rotary valve pairs working in opposite directions the rotary valves can also be supported or lubricated to one another by gas pressure support.

For this reason only the corresponding openings or recesses are necessary. By way of replacement for the rotor disk and rotary valves, as above, water instead of lubricant can be introduced through the corresponding holes; at the operating temperature the water becomes steam and thus a corresponding pressure for pressure support is achieved.

The number of individual parts and sealing elements used is less than in comparable designs. The combustion space at the instant of ignition is as close as possible to the ideal shape of a sphere, at least to a cylindrical shape, by which combustion is complete and the proportion of unburned gases in the exhaust remains as small as possible.

In the engine according to the invention there is clear separation of the propulsion and working spaces. For a very small box dimension a favorable power-weight ratio and high power density can be achieved. No special machinery need be built to produce the engine, as is necessary for example in Wankel engines. All parts can be produced with known machine tools. Since also all additional assemblies, such as the starter, generator, exhaust, carburetor, injection system and so forth can be series produced parts, additional development costs are avoided. The engine structure is simple, it contains few wearing parts such as seal rings, and no oil is necessary for lubrication of the inside cylinder walls. This prevents high maintenance and the corresponding costs. Any liquid and gaseous fuels can be used, resulting in low operating costs. Since no lubricating oil need be used, changing the oil is superfluous for most applications.

Additional injection of finely atomized water into the combustion space can also be used to increase engine output or to save fuel.

At the combustion temperatures which occur in the combustion space, exceeding 1000° C., the water explosively becomes steam and thus increases its volume by several fold—compression is increased—but at the same time combustion of the fuel-gas mixtures can be influenced (lowering of the octane number).

In reciprocating piston engines which work against top and bottom dead center of the pistons, this can lead to much higher material stress and thus to much higher maintenance costs, shorter service life of the engine and to much higher manufacturing costs.

In the engine according to the invention all the advantages of water injection can be used without the need to tolerate disadvantages. Because combustion always takes place behind the receding piston, soft combustion always takes place regardless of which fuel and what compression or rpm are being used.

Since very high compression is easily possible, turbochargers or other compressors can be used. In this way the engine according to the invention can have an extremely high power density.

To facilitate starting, in the intake or compression part there can be a decompression valve. Since the engine according to the invention has a lower inherent braking effect when the accelerator lever is pulled back than a reciprocating piston engine, there can be a throttle valve in the exhaust line or intake line of the engine.

This invention combines the advantages of a reciprocating piston engine with the advantageous properties of the turbine and can so to speak be classified in the middle between the two known designs. The most important feature is the gas exchange according to the reciprocating piston principle in the closed space. In this way it can be used as a motor vehicle and aircraft engine and also for helicopters.

Not only due to high power density and small box size, but also the simultaneous possibility of use as a hydraulic and/or pneumatic pump and/or drive, the engine according to the invention can be very easily be used in many areas where internal combustion engines, hydraulic and pneumatic pumps and drive systems are used. Very low production costs, low maintenance costs and low operating costs further expand possible applications.

The engine according to the invention avoids complicated and noisy valve drives and the fatigue limit stress on gear parts, crankshaft and connecting rods, which limits rpm in conventional reciprocating piston engines. Also the disadvantages of turbines, such as sluggish control behavior, poor exhaust gas quality and poor efficiency, which limits their use as motor vehicle engines to a few special cases such as large vehicles, tanks and the like, are prevented with this invention. With the engine according to the invention it is not a problem to reach high rpm. In it the maximum rpm is limited not by the allowable fatigue limit of gear parts, but only by the combustion speed of the fuel used, which is generally 20 to 30 m/s.

In one embodiment of this invention the engine consists of an annular cylinder (torus) in which at least two pistons with a cross section which corresponds to the diameter of the annular cylinder rotate. The pistons are attached on the periphery of a driver plate (rotor disk) in a suitable manner, such that in spite of the centrifugal force they do not rub against the inner outside contour of the annular cylinder. Although pistons with commercial piston rings can be sealed against the cylinder wall, the use of materials with a very hard surface structure and low coefficient of expansion and a very small gap between the pistons and the inside wall of the cylinders is sufficient. If a seal as tight as possible is necessary for the application, gas pressure labyrinth seal lubrication can be provided. Since the pistons run without contact and friction and without oil, wear on cylinder walls and pistons is eliminated. No oil combustion residues reach the exhaust gas, and no carbon deposits form on the piston bottoms or ignition equipment. Operation is quiet and service life is increased since the internal friction is greatly reduced. The major increase of friction losses with rpm, as is known in reciprocating pistons, is prevented in the rotating pistons used according to the invention. In a hot reciprocating piston engine at compression of 1:10 losses due to piston and piston ring friction alone can be 50 to 60% of all internal friction and they are completely eliminated with the rotating piston used according to the invention. Fuel consumption is minimized, and exhaust quality optimized.

In another embodiment without an intake compression chamber the fresh gas compressed by the compressor is retained in the intake channel against the rotary valves when the pistons move from one expansion chamber into the next and then is ignited and expanded behind the receding piston and against the closed rotary valve.

The danger of removal of the oil film by fuel condensation which occurs when a piston engine is started cold is avoided, because an oil film in the cylinder is no longer necessary. The oil-free cylinder also allows use of the engine in dusty, dry combustion air, for example in the steppes or desert, because the dust is blown through the cylinder without adhering to the cylinder wall.

The inside wall of the annular cylinder need not be made wear-resistant. At the same time a certain degree of roughness of the inside wall of the cylinder, for example due to tool marks, is desirable because the surface roughness reduces leakage losses through the gap between the pistons and cylinder wall since the roughness reduces the gas velocity in the narrow gap. The cylinders are therefore preferably not ground from the inside.

The gas pressure labyrinth pistons preferably used contain in the piston bottom a thin central blind hole which on its end passes into even thinner transverse holes which emerge laterally from the piston. The weak counterpressure which occurs here counteracts leakage losses so that a sufficient seal is ensured. It is known anyway that sealing of machine components which move relative to one another can only ever cause "technical tightness", but never absolute tightness. The "blow-by" of hot combustion gases which is feared by engine designers does not occur in the rotating piston used according to the invention because the rotating pistons recede before the heat front and in high frequency migration of the heat-stressed sites on the annular cylinder wall in the direction of rotation "blow by" cannot occur at all. Nor would it be harmful since the combustion gases would simply reach to in front of the pistons and would be pressed by them into the exhaust channel and thus into the exhaust.

The number of pistons, cylinder chambers and rotary valves is preferably the same. They are preferably each arranged at the same angle to one another. In the embodiment with the intake compression chambers during each revolution the four "strokes" of the ICE are carried out as frequently as the product of the number of pistons×the number of expansion chambers. This means that in an engine version with four pistons and four cylinder chambers, of which two are made as expansion chambers, in one annular cylinder ignition takes place (2×4) equals 8 times, in the two expansion chambers ignition always taking place at the same time. Each of the four pistons compartmentalizes the four cylinder chambers once at a time. Therefore, for rotation of 360° four times the annular cylinder volume is used. The usable working volume for a 360° revolution is a multiple of the actual annular cylinder volume, specifically the piston or cylinder chamber number×the actual volume of the annular cylinder. This multiple use of the annular cylinder volume is not possible in any other internal combustion engine with closed combustion spaces.

The problem of diverting the fresh gas behind the rotating piston which is compressed in front of the piston, a problem which is difficult to solve in all rotary machines, is solved as follows in the embodiment with intake combustion chambers: The fresh gas is retained in the overflow channel or in the intake channel when the piston moves from the intake compression chamber into the expansion chamber until the piston has run through the rotary valve recess and is then ignited in the expansion chamber behind the receding piston. The annular cylinder is divided by the rotary valves into at least two cylinder chambers, into one expansion chamber and one intake compression chamber. In machines with more than two cylinder chambers there can also be at least one hydraulic chamber and/or one pneumatic chamber. The number of pistons, cylinder chambers and rotary valves or rotary valve pairs is preferably the same, they are located on the same plane, preferably at the same angle to one another.

In the embodiment with intake compression chambers, at the end of one intake compression chamber at a time and at the start of one expansion chamber there are recesses in the cylinder wall which are joined to one another by an overflow channel. One rotary valve with the corresponding rotary valve recesses fits in the overflow channel. The part of the overflow channel or the intake channel which, viewed from the rotary valve, is located on the side of the expansion chamber is preferably used at the same time as the combustion space with the expansion chamber. The piston is preferably longer than the overflow channel so that it can close the latter briefly upon passage. The ignition device is preferably located in the overflow channel behind the rotary valve or in the expansion chamber of the annular cylinder.

On its front and/or back the piston can preferably have a projection which is shaped such that it is matched to the advancing rotary valve opening so that the piston can enter the rotary valve opening even before the annular cylinder cross section is completely cleared. Likewise it can emerge again when the opening closes. The volume of the projections on the one hand reduces the compression space in front of the still closed rotary valve and thus increases the compression of the fresh gas upon entry into the overflow channel. Secondly, the piston is prevented from pushing or entraining the gas mixture or liquids from one cylinder chamber into the next one. The openings for the intake and exhaust channel are preferably, as in a two-stroke reciprocating piston engine, always opened. They require no mechanical control and are briefly washed and thus closed only by the rotating piston.

The invention is detailed below using the Figures by way of example.

DETAILED DESCRIPTION OF DISCLOSED EMBODIMENTS

Figure 1:
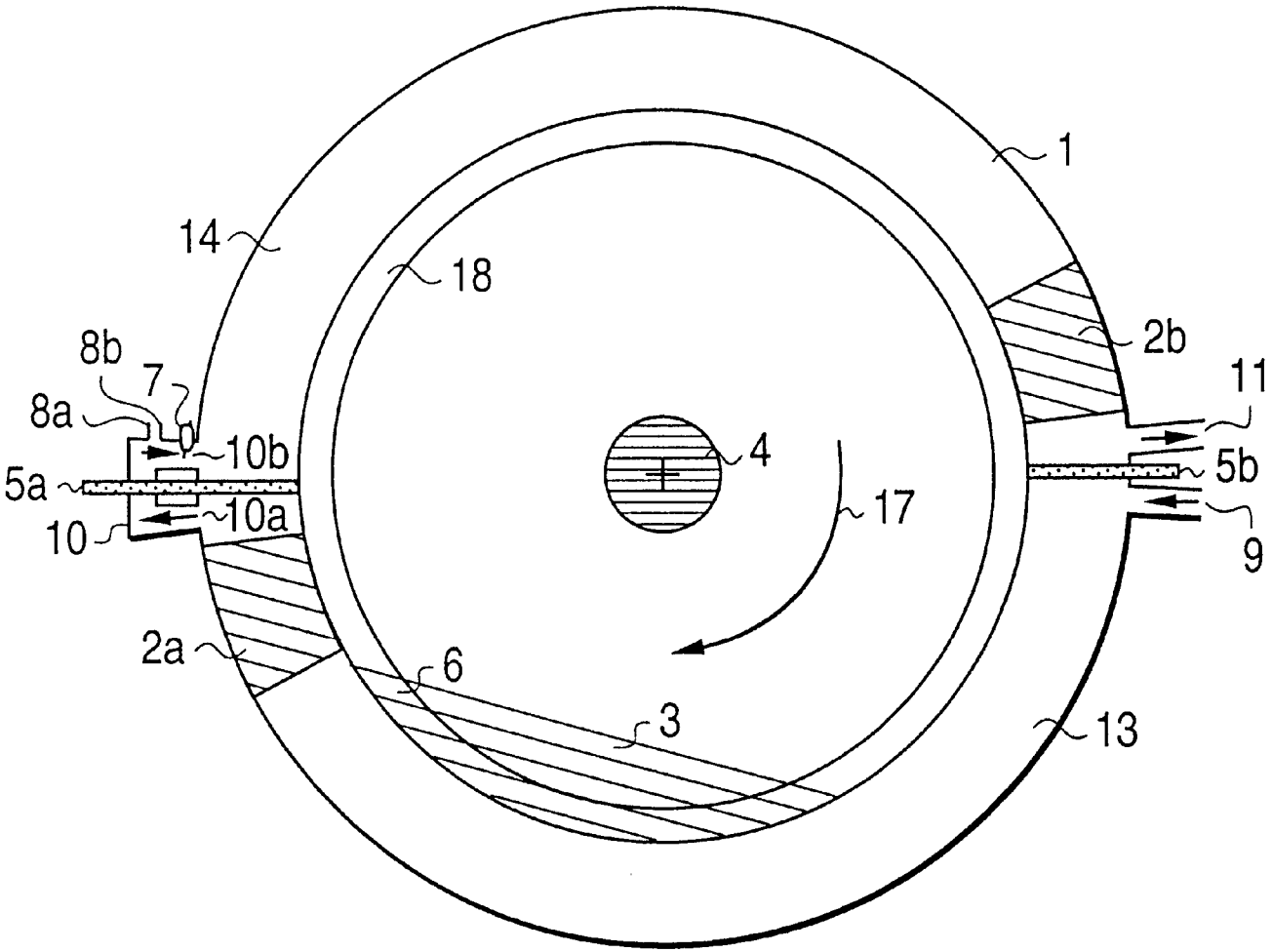
FIGS. 1 through 4 shows the gas exchange phases of the engine, the annular cylinder with the piston being shown in FIGS. 1 through 4 in each of four different phases of rotation.

FIG. 1 shows annular cylinder 1 in which run two rotating pistons 2*a,* 2*b* which are attached to rotor disk 3. Rotor disk 3 is securely joined to driven shaft 4. Rotating pistons 2*a,* 2*b* run in direction of rotation 17 in annular cylinder 1.

In the compression phase shown in FIG. 1, rotating piston 2*a* has largely compressed the fresh gas in intake compression chamber 13. The fresh gas in chamber 13 is pressed against closed rotary valve 5*a* and via outlet line 10*a* into overflow channel 10. Behind rotary piston 2*a* new fresh gas is aspirated at the same time via intake channel 9.

Rotary valve 5*a* in this phase also closes annular cylinder 1.

In the direction of rotation of the pistons behind rotary valve 5*a,* i.e., on the side of valve 5*a* opposite chamber 13, the ignited gas mixture originating from the prior stroke expands and pushes rotating piston 2*b* in expansion chamber 14 to shortly in front of rotary valve 5*b*. At the same time, in front of rotating piston 2*b* the burned residual gases from the prior expansion stroke are pressed via exhaust channel 11 into the exhaust system.

Rotary valve 5*b* is likewise closed. Rotor disk 3 extends on annular cylinder wall 18 through rotor disk contact 6.

Figure 2:
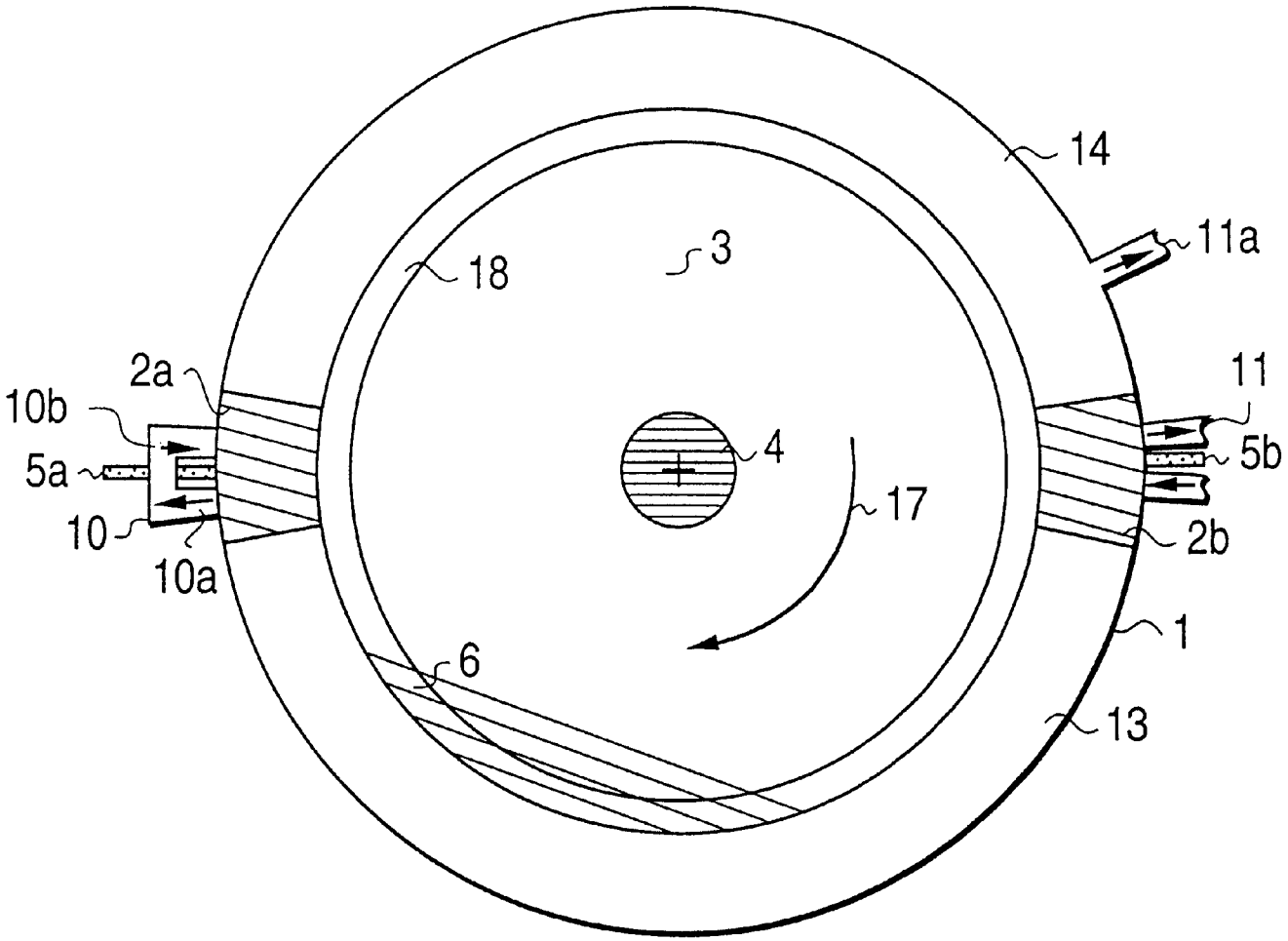

In the phase shown in FIG. 2 which follows the one shown in FIG. 1, two rotary valves 5*a* and 5*b* are opened for piston passage, likewise rotary valve 5*a* is opened in overflow channel 10. The compressed fresh gas is located in overflow channel 10, piston 2*a* closes outlet line 10*a* from intake compression chamber 13 and inlet line 10*b* into expansion chamber 14. Rotary piston 2*b* at this time closes intake channel 9 and exhaust channel 11.

Exhaust channel 11 can also be located further to the rear in direction of rotation 17, as is shown by reference number 11*a*. In this arrangement, at this time the ejection of burned gases takes place behind rotating piston 2*b*. Exhaust gas channel 11*a* is spaced apart from rotating valve 5*b* at a distance which is preferably somewhat greater than the length of the rotary piston.

Figure 3:
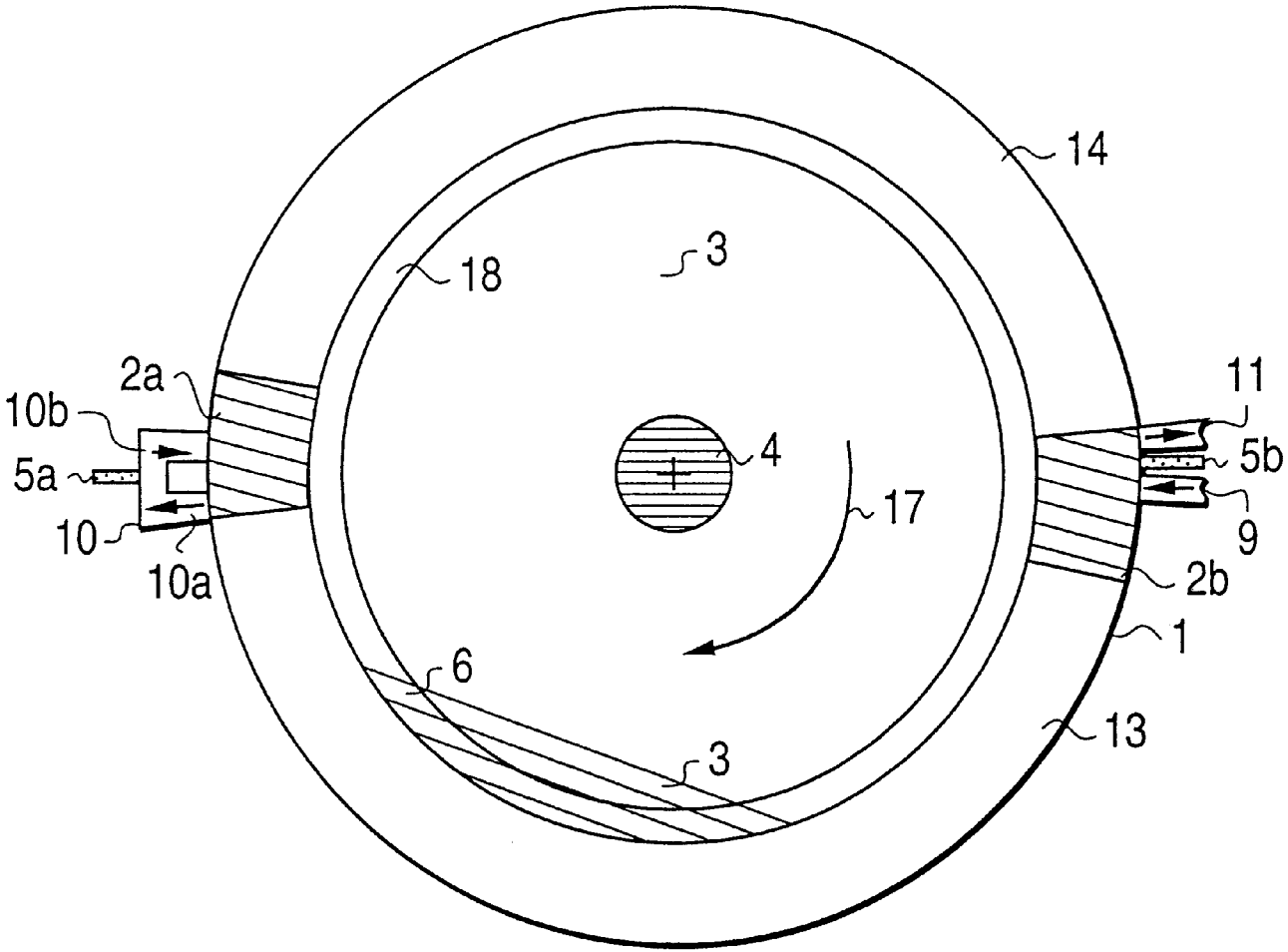

In FIG. 3 rotary pistons 2*a,* 2*b* have moved further in direction of rotation 17. Overflow channel 10 is now closed by rotary valve 5*a* which is preferably located roughly in the middle of overflow channel 10. At this time injection of fuel preferably takes place via the injection device for fuel 8*a* shown in FIG. 1, optionally also an additive via additive injection device 8*b* or ignition of the compressed gas mixture by ignition device 7; the arrangement of the latter is shown in FIG. 1.

Figure 4:
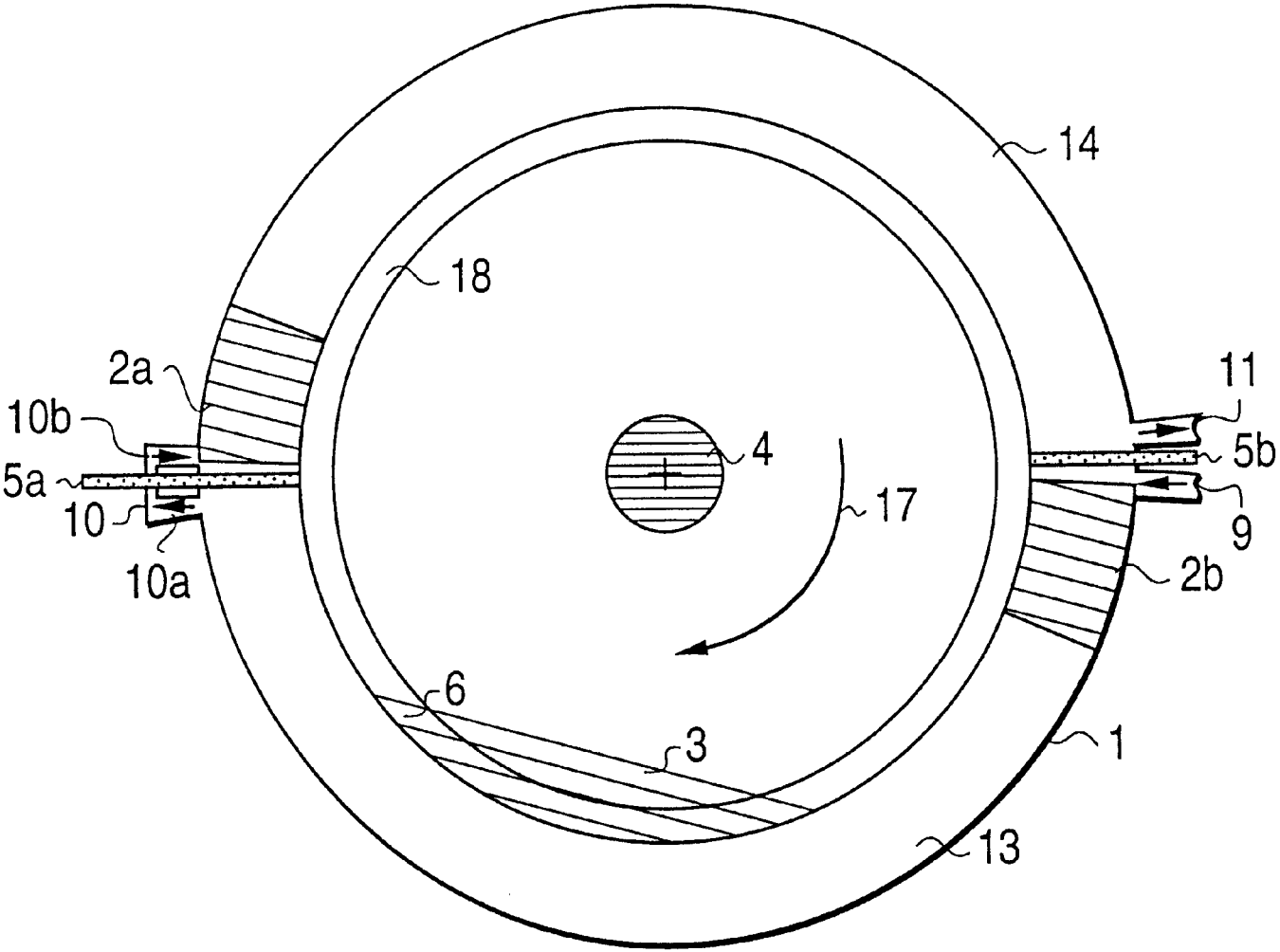

In the position shown in FIG. 4 with pistons 2*a,* 2*b* which have continued to advance in direction of rotation 17, rotary valve 5*a* in turn closes annular cylinder 1 and overflow channel 10. Rotary valve 5*b* likewise closes annular cylinder 1. Between rotary valve 5*a* and the bottom of the piston on the rear part of piston 2*a* the spreading expansion drives piston 2*a* in direction of rotation 17. The remaining fresh gases in overflow channel 10 on the half of overflow channel 10 facing intake compression chamber 13 and divided by rotary valve 5*a* continue to be used by next piston 2*b* which compartmentalizes afterwards and are compressed; they are not lost. Piston 2*a* pushes the burned residual gases of the prior expansion in front of itself via exhaust channel 11 or 11*a* into the exhaust system. Between closed rotary valve 5*b* and the bottom of piston 2*b* which is the rear one in direction of rotation 17 fresh gas is aspirated via intake channel 9. In front of piston 2*b* fresh gas is compressed toward closed rotary valve 5*a*.

Figure 5:
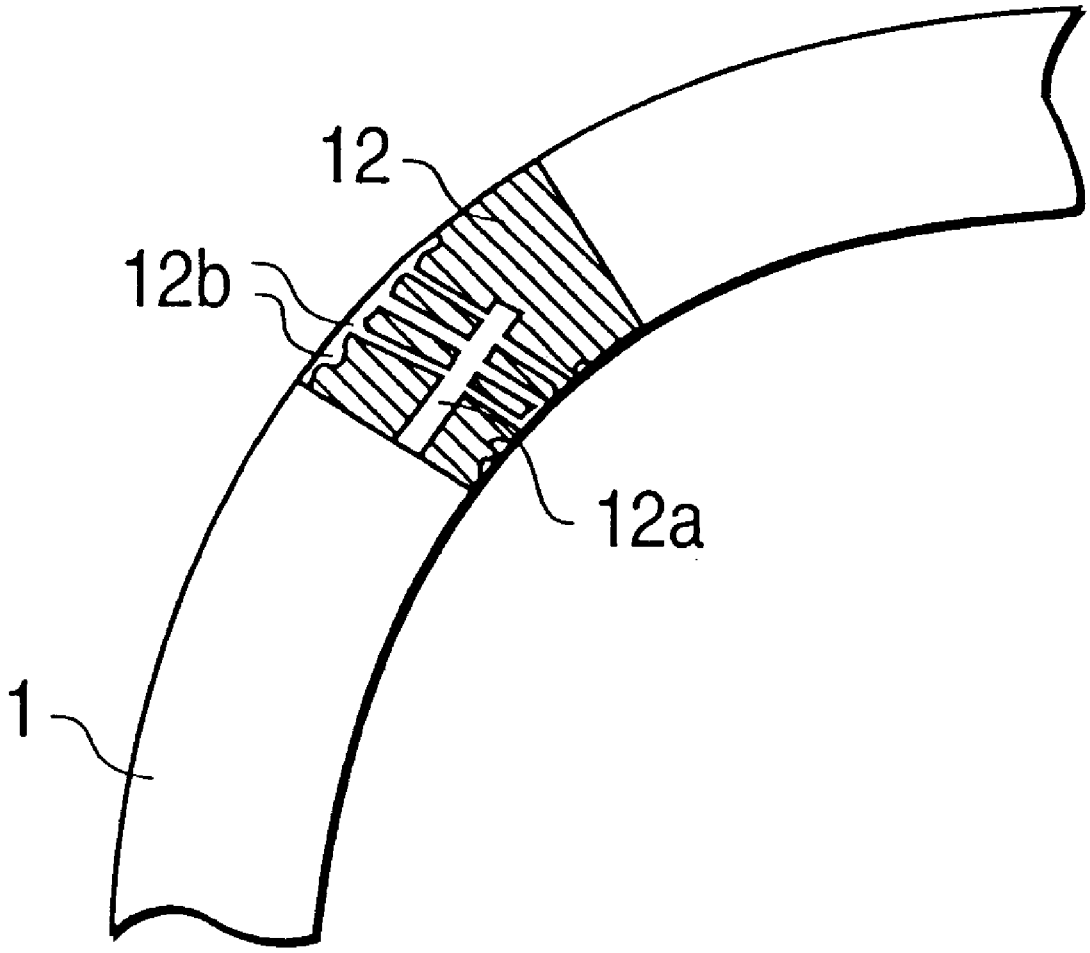
FIG. 5 shows a detail of the annular cylinder with gas pressure labyrinth piston.

FIG. 5 shows a detail of annular cylinder 1 with a rotary piston which runs in it, which is matched to the cross section of the annular cylinder, and which is made as gas pressure labyrinth piston 12. In the middle of the piston in the peripheral direction is center hole 12*a* in the rear part of the piston. Choke points 12*b* are located on the side surfaces of the gas pressure labyrinth piston facing the annular cylinder wall.

Figure 6:
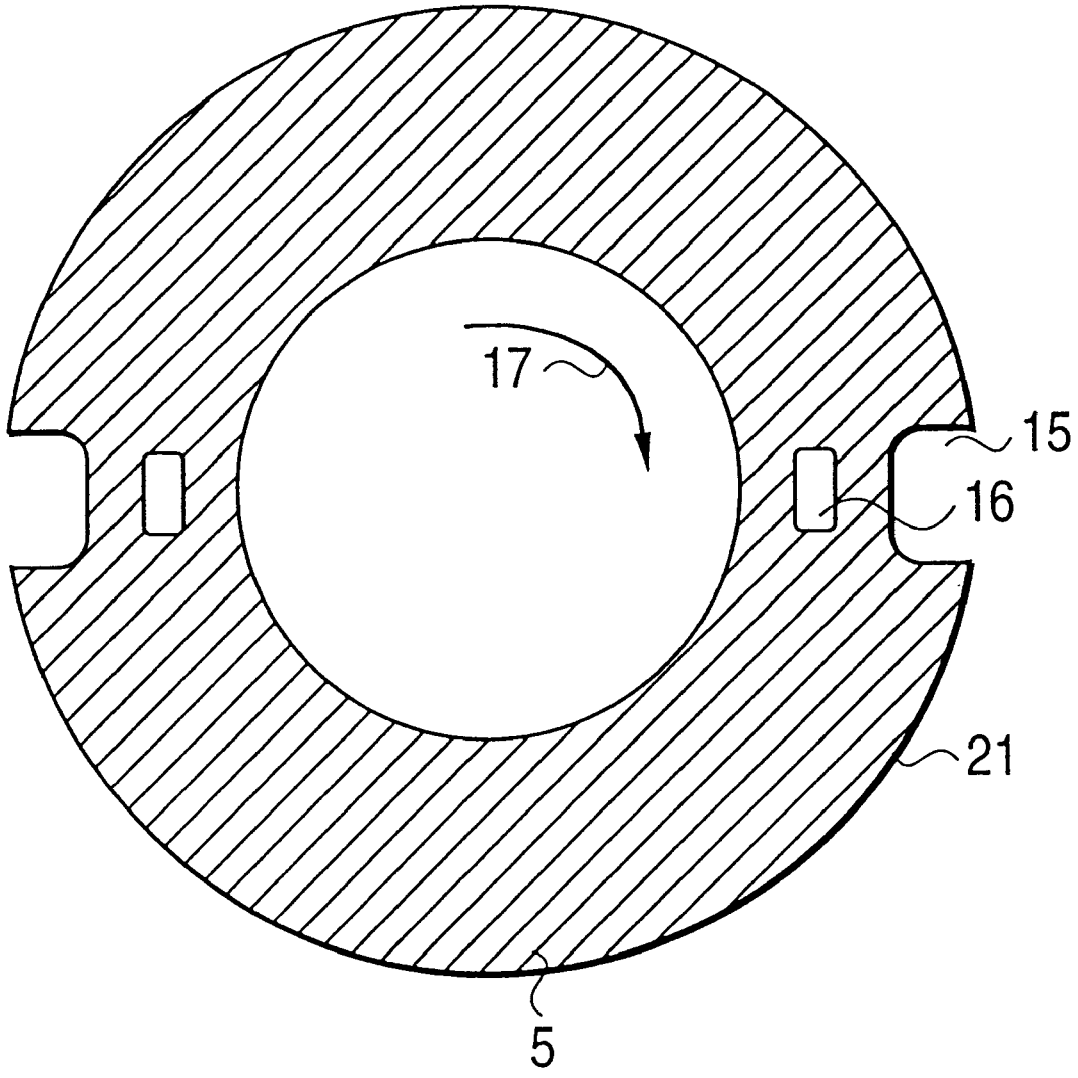
FIG. 6 shows one embodiment of the rotary valve ring disk.

FIG. 6 shows rotary valve 5 made as rotary valve ring disk 21. It contains recesses 15 for rotating piston 2 and recesses 16 for overflow channel 10. The shape, size and arrangement of recesses 15 and 16 depend on the configuration of rotating piston 2 and overflow channel 10, the rpm of the rotary valve and the desired time and duration of gas exchange in overflow channel 10 or intake channel 9. If this rotary valve is used for an engine version with two pistons and two chambers, it rotates with the same rotational speed around its axis as the rotor disk with rotating piston 2 around axis 4. The middle point of the two axes is the same.

Figure 7:
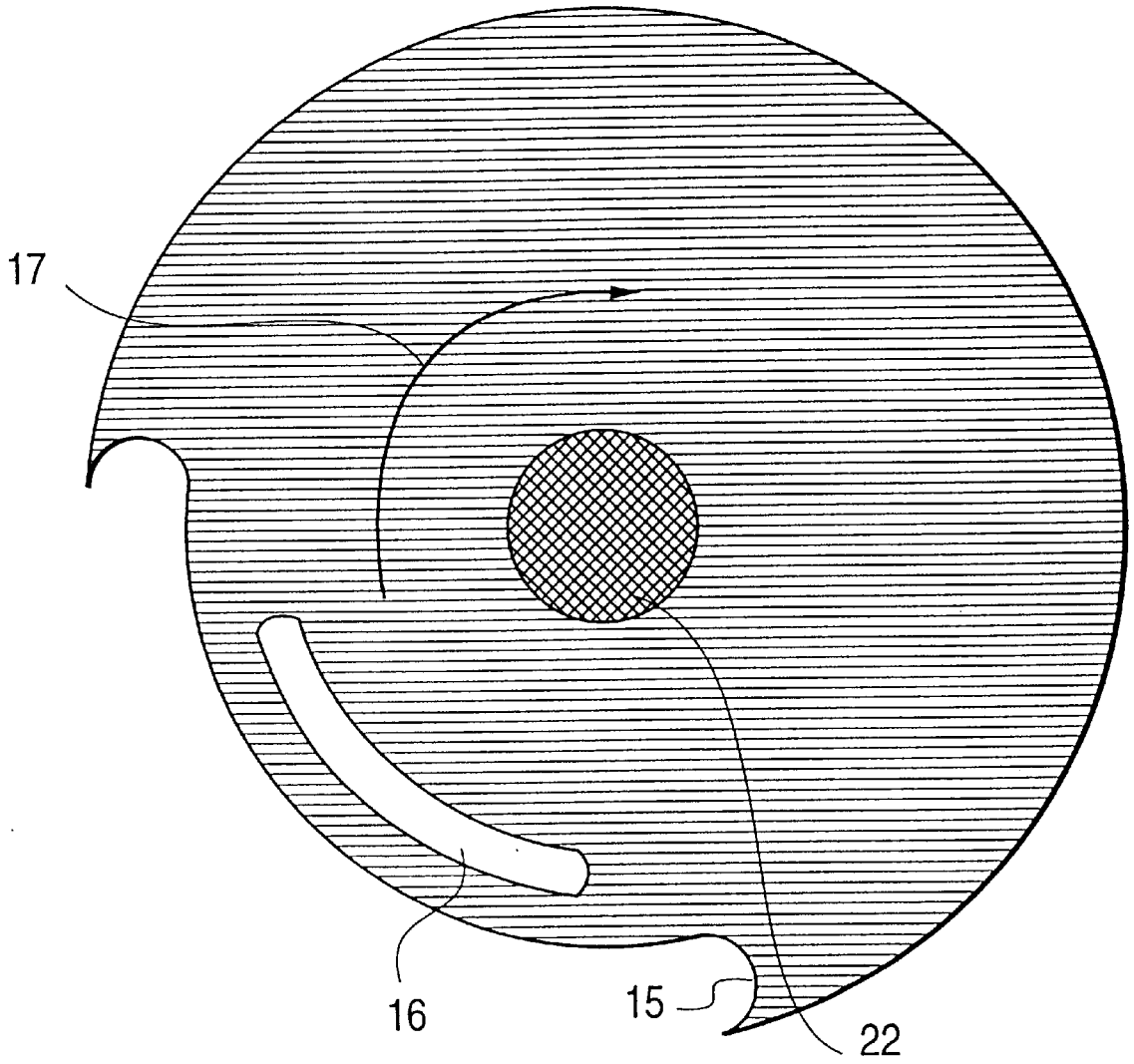
FIG. 7 shows another embodiment of the rotary valve.

FIG. 7 shows a corresponding rotary valve which has a higher rpm than the rotor disk. For example, in the motor version with three pistons and three cylinder chambers the rotary valve turns three times as fast.

Figure 8:
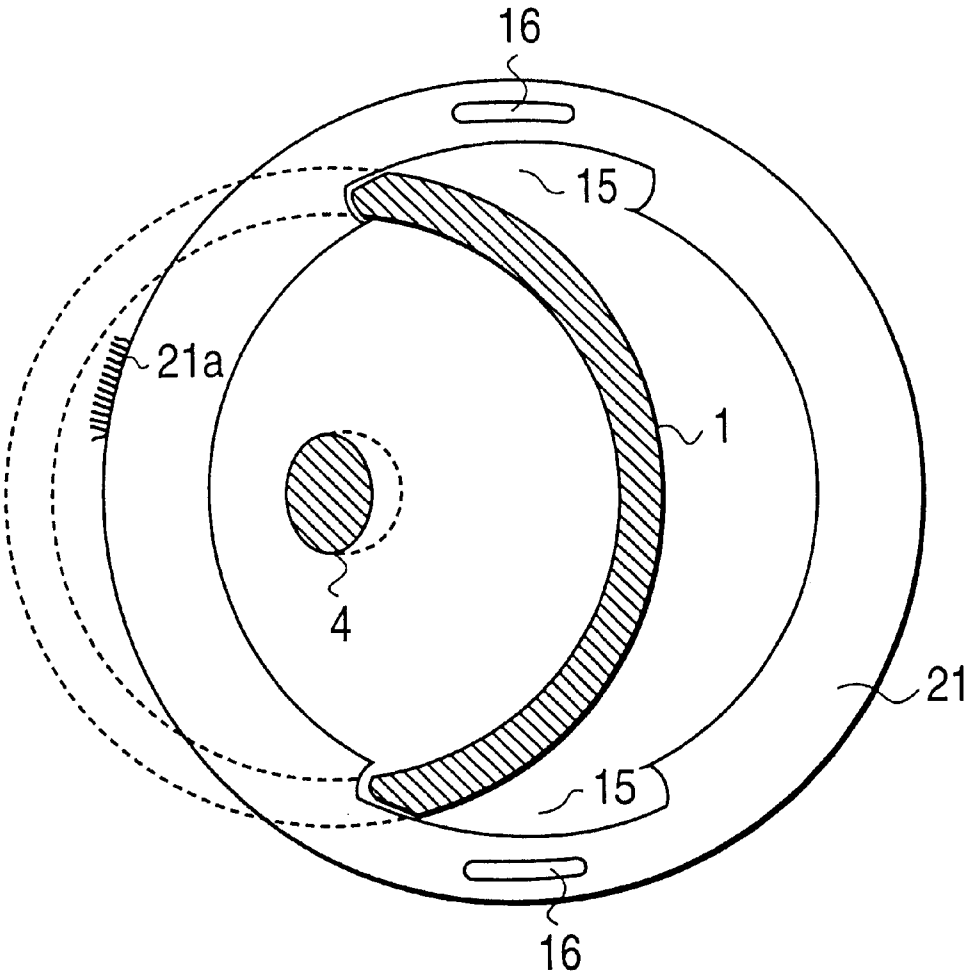
FIG. 8 shows an rotary valve arrangement in an annular cylinder, made as a rotating cylinder ring disk.

FIG. 8 shows rotary valve ring disk 21 with its recesses 15, 16 in an overhead view which divides annular cylinder 1 turned somewhat to same center axis 4 into two chambers. The part of annular cylinder 1 which in front of the plane of rotary valve ring disk 21 faces the observer is blackened. The part which is behind the plane of the rotary valve is in dashed lines. Teeth 21*a* for the drive of rotary valve ring disk 21 is shown only in sections on the outside of rotary valve ring disk 21, but it can also be located on the inside. Here rotary valve ring disk 21 would cut the annular cylinder from the inside.

As is apparent from FIG. 6, there can be rotary valve ring disk 21 solely in a two-chamber annular cylinder, since an arrangement of several rotary valve ring disks 21, at different angles to one another, but with the same center point, would necessarily intersect on opposite sides.

Figure 9:
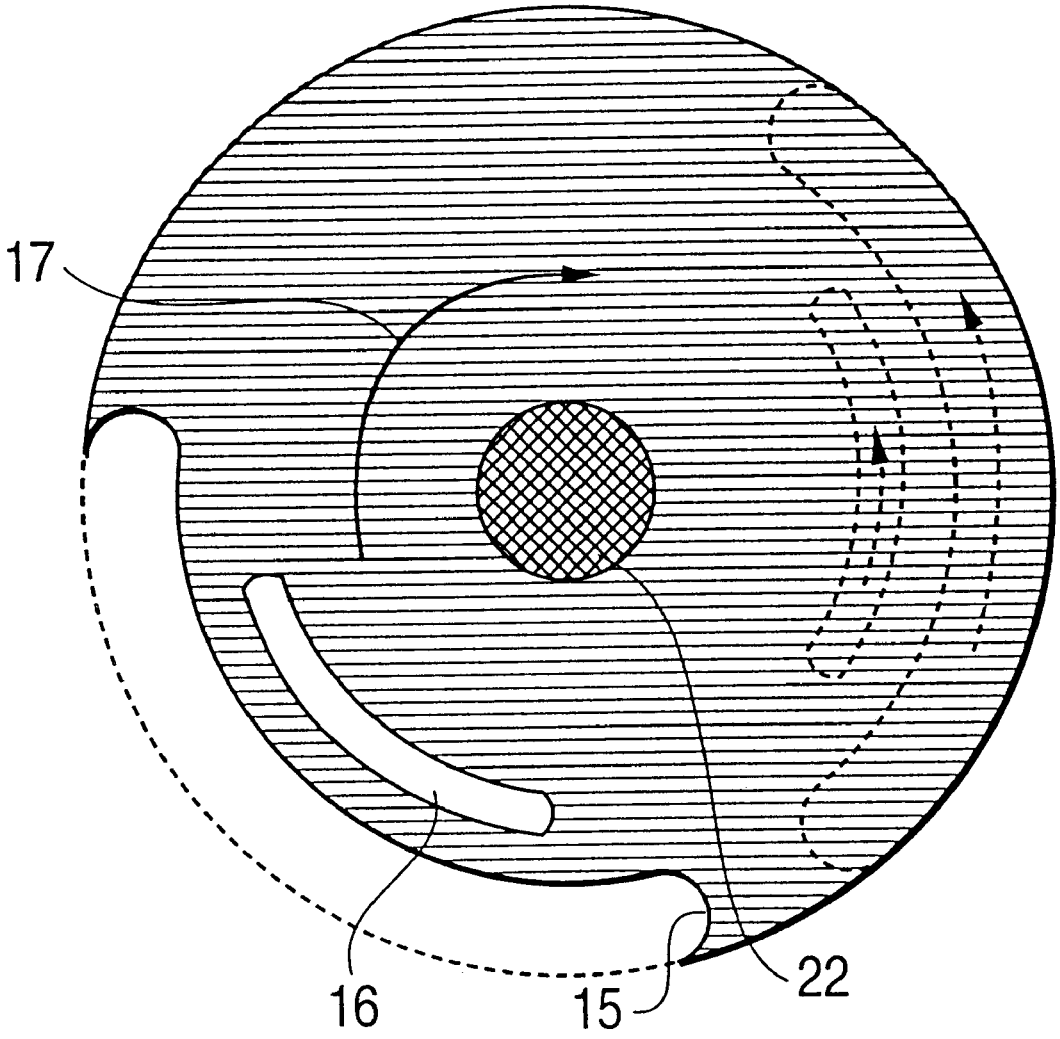
FIG. 9 shows an arrangement of two rotary valves working in opposite directions.

FIG. 9 shows an arrangement of two rotary valves 5 working in opposite directions, of which one turns counterclockwise, while direction of rotation 17 of other rotary valve 5 is clockwise. Rotary valve recesses 15, 16 of top visible rotary valve 5 are visible, lower recesses of lower rotary valve 5 are shown by broken lines.

Figure 10:
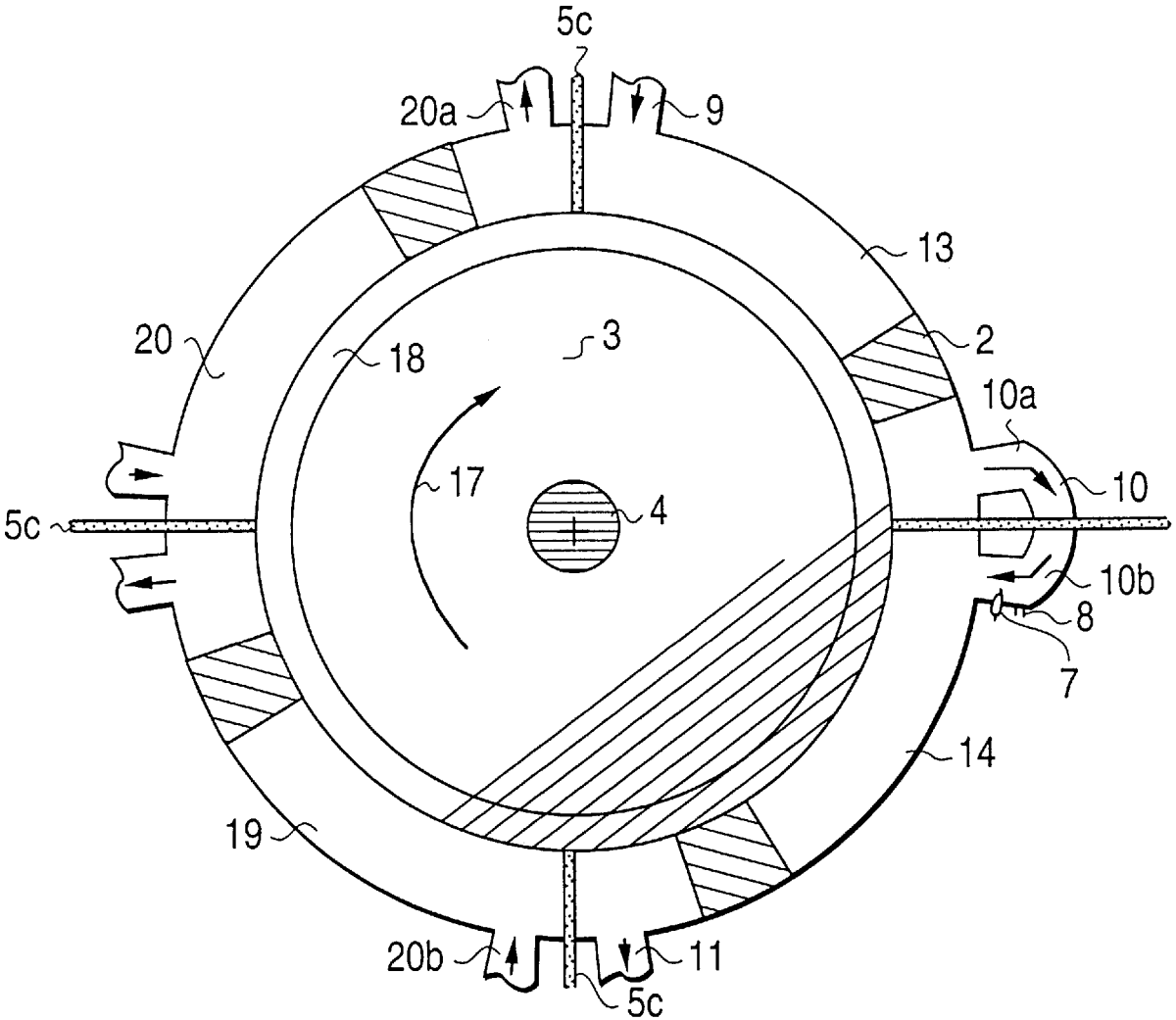
FIG. 10 shows one embodiment of the engine with four cylinder chambers and four pistons.

FIG. 10 shows one engine version which is made as a four-piston, four-chamber engine, in which cylinder chamber 19 can be used as a hydraulic pump or drive and cylinder chamber 20 as a pneumatic pump or drive. Here it is feasible to connect pneumatically used cylinder chamber 20 downstream of hydraulically used cylinder chamber 19 in direction of rotation 17 since small amounts of the hydraulic medium which can be entrained in passage from one to the next cylinder chamber, can be captured by a suitable capture device in the discharge system downstream of discharge channel 20*a* and can be returned to the hydraulic circuit.

Figure 11:
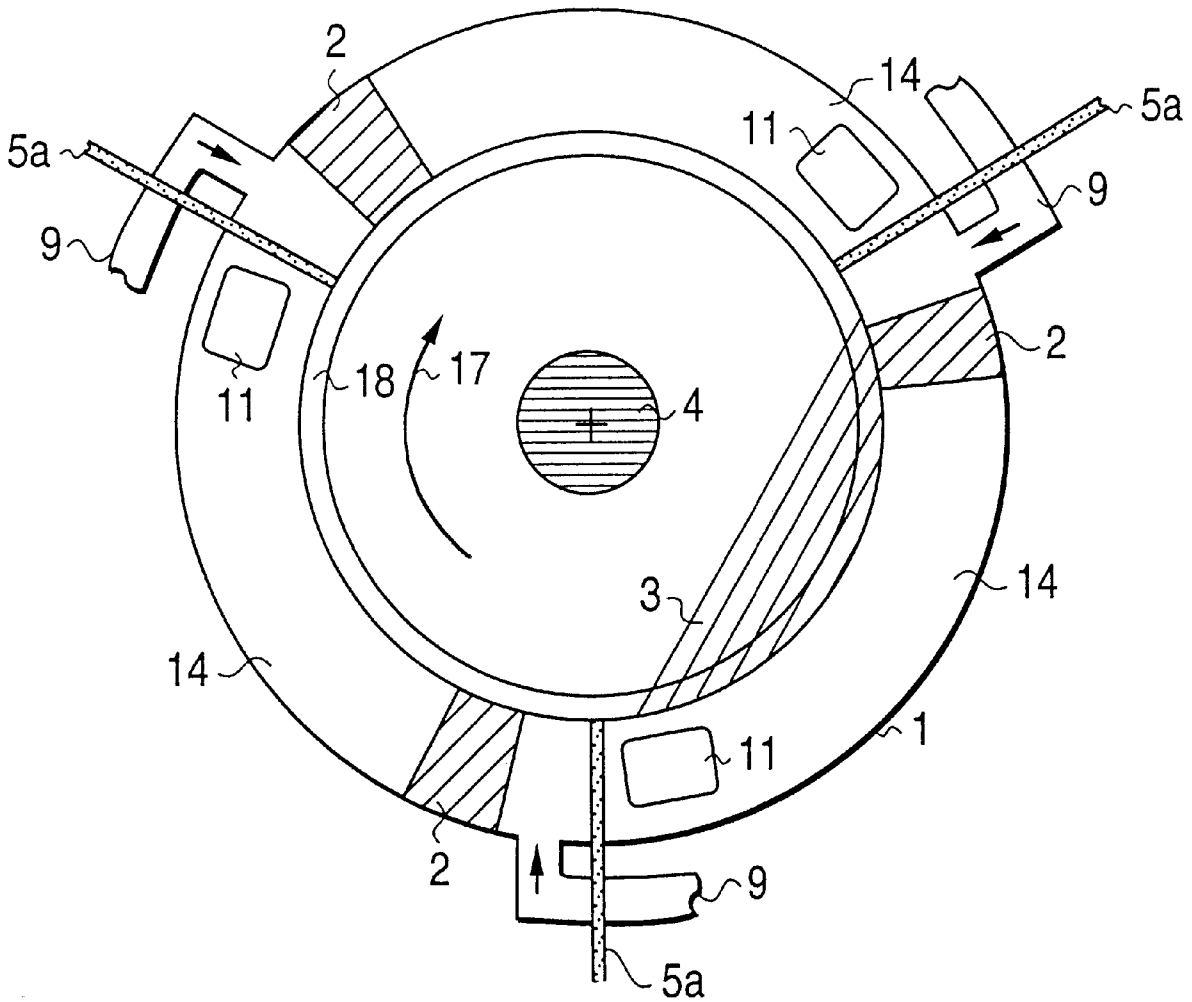
FIG. 11 shows a three-chamber annular cylinder only with expansion chambers.

FIG. 11 shows a three-chamber annular cylinder only with expansion chambers 14. In this embodiment compression of the fresh gas takes place externally by a compressor. The compressed fresh gas is pressed into expansion chambers 14 after opening of rotary valve 5*a* via intake channels 9.

Figure 12:
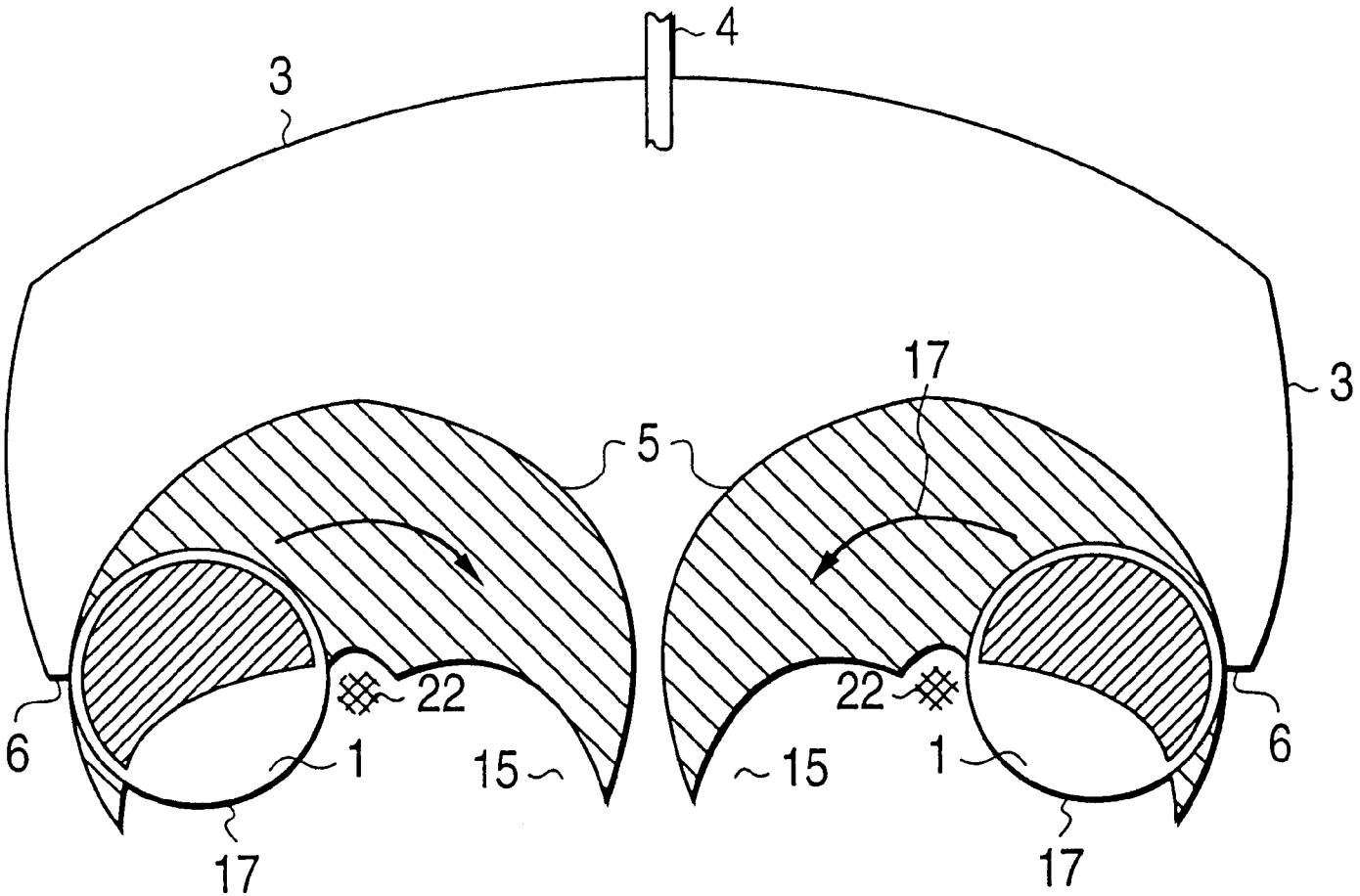
FIG. 12 shows a section through an annular cylinder with spherical rotor disk.

FIG. 12 shows a hemispherical rotor disk with the point where it fits into the cylinder wall shifted to the outside. It shows a section through annular cylinder 1 and spherical rotor disk 3 along axis 4, rotary valves being shown in an overhead view. The blackened part of the rotary valves shows the space of annular cylinder 1 partially closed by rotary valve 5. This embodiment could be made either as a two-chamber cylinder with two rotary valves at 180 degrees to one another or as a four-chamber cylinder with four rotary valves at 90 degrees to one another, but without imaging of the rotary valves which are located in front of and behind the intersection line. Rotary valves 5 are located on the inside of annular cylinder 1.

Figure 13:
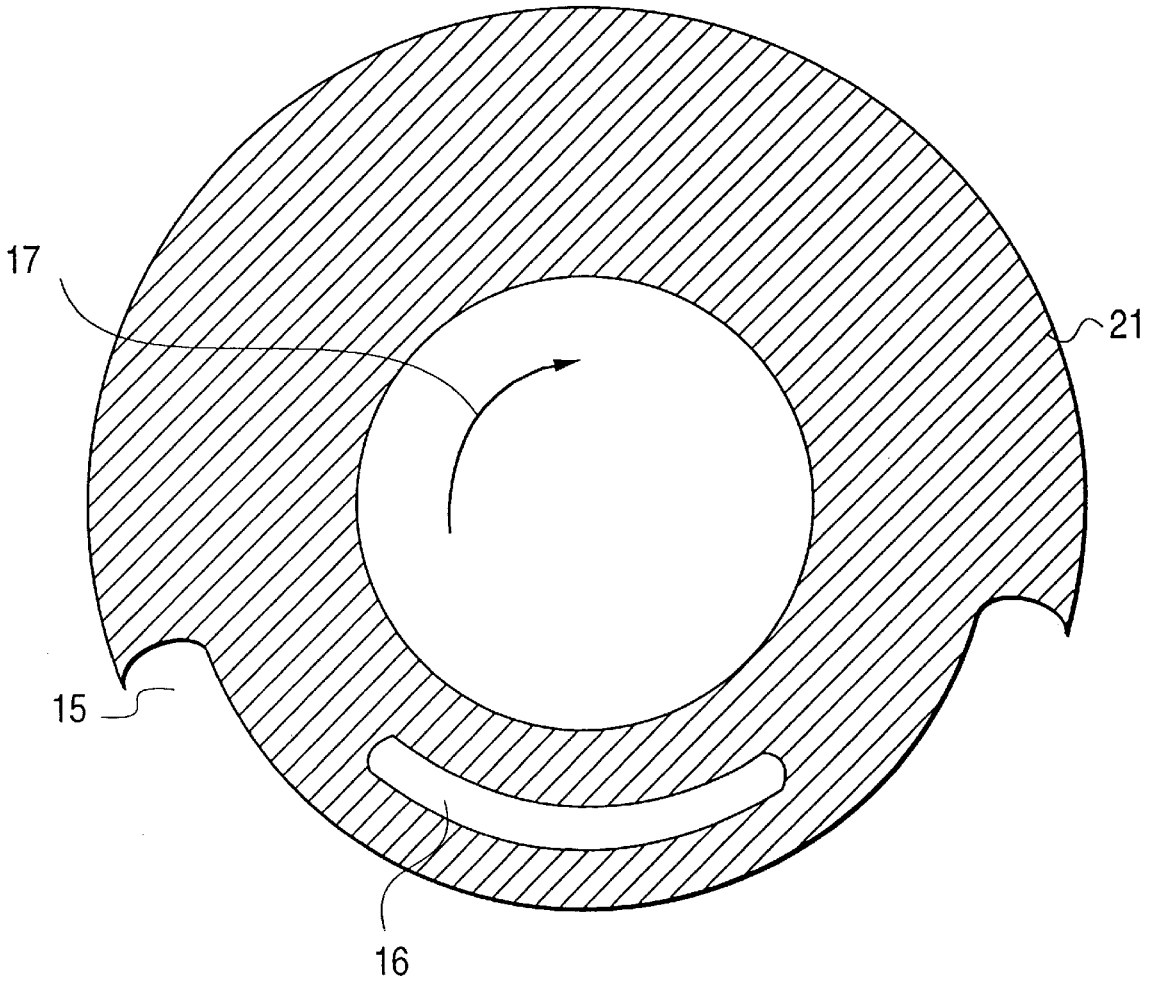
FIG. 13 shows another embodiment of a rotary valve ring disk.

FIG. 13 shows a rotor disk with single rotary valve recess 15 for piston passage and single rotary valve recess 16 for gas exchange in overflow channel 10. It turns for example in direction of rotation 17 around the middle point of axis 4. If this rotary valve is used for a two-piston, two-cylinder engine, it must rotate with twice the rpm as the rotor disk with the rotating piston.

In all embodiments shown in the figures, rotor disk 3 is attached torsionally strong on driven shaft 4. It is located on it at a right angle. The outside contour of rotor disk 3 is ground and polished preferably on both sides. Although bilateral sealing of rotor disk 3 with gaskets is possible, for better sealing there are preferably grooves and lands which fit into one another in order to increase the boundary surfaces to be sealed. As dictated by the application, additional oil lubrication can be provided. Driven shaft 4 is preferably guided in several radial separable ball bearings which can accommodate axial thrusts.

Rotary valves 5 are attached torsionally strong on one shaft 22 each. Because the interplay of rotary valve recesses 15 and 16 with rotating piston 2 must function very exactly, rotary valve shafts 22 are mechanically synchronously joined to driven axle 4 in a gear ratio which is exactly defined depending on the engine version. The interfitting parts of these mechanical connections can be oil-lubricated. Rotary valve shafts 22 and mechanical connections to driven axle 4 preferably rotate in separable ball bearings. It is provided that if necessary all turning axles are supported against the collar on the two ends in one motor housing. Other connections of the turning parts, their bearing and attachment are however possible. Rotary valves 5 are used preferably in two embodiments. Rotary valve 5*a* controls on the one hand piston passage between cylinder chambers 13, 14, 19, 20 and on the other hand the gas flow or liquid flow in overflow channel 10 or in intake channel 9. Rotary valve 5*b* controls piston passage between the cylinder chambers in the annular cylinder. To suitably capture minor leakage losses, return them again to the circuit if necessary, and to minimize them, there is preferably an engine housing which is as true to size as possible and which can also accommodate water cooling.

The motor according to the invention after careful balancing of rotating pistons 2, rotor disks 3 and rotary valves 5 and after thorough sealing to the housing runs so quietly that the secondary engine noise, for example from generators or fans, becomes important.

As in all known engines, a multicylinder version is possible. For example, there can be several annular cylinders arranged in a star-shape around a central rotary valve so that all annular cylinders are controlled with one rotary valve, thus each of these annular cylinders in a two-piston, two-chamber version requires only one more rotary valve per cylinder.

What is claimed is:

1. An engine comprising one or more annular cylinders with round cross section, in each annular cylinder there being at least two rotating pistons with cross sections which correspond to the cross section of the annular cylinder, and which rotating pistons are located on the periphery of a rotor disk which sits torsionally strong on one shaft, each annular cylinder being divided by plate cams which are made as rotary valves and which penetrate slots with peripheral areas located transversely to the extension of said annular cylinders, and said rotary valves dividing their annular cylinder into cylinder chambers including an intake compression chamber and an expansion chamber and said rotary valves having as control recesses therein rotary valve recesses, and each annular cylinder having at least one intake channel opening and at least one exhaust channel opening and at least one overflow channel with outlet and inlet openings from and to said annular chamber which are opened and closed by said pistons, wherein said rotary valves include:

a) a rotary valve which fits into each overflow channel and into said annular cylinder between said intake compression chamber and said expansion chamber thereof, and b) a rotary valve which fits into said annular cylinder between said expansion chamber and said intake compression chamber thereof, c) wherein said rotary valve recesses include recesses arranged in said rotary valves such that they clear each annular cylinder for passage of said rotating pistons thereof, and d) wherein said rotary valve recesses include recesses arranged in said rotary valves such that they clear said overflow channels directly before or during closure of said outlet opening and during closure of said inlet opening by said rotating pistons.

2. Engine according to claim 1, wherein said annular cylinders have a circular cross section.

3. Engine according to claim 1, wherein each of said annular cylinders is divided into at least two cylinder chambers of the same size.

4. Engine according to claim 1, wherein each annular cylinder is divided with more than two cylinder chambers, at least one of these cylinder chambers being used as a hydraulic and/or pneumatic pump and/or for hydraulic and/or pneumatic drive of pistons.

5. Engine according to claim 4, wherein at least one of said rotary valves borders said hydraulic and/or pneumatic cylinder chambers where said at least one rotary valve fits into said hydraulic and/or pneumatic cylinder chambers where said at least one rotary valve fits into said annular cylinder.

6. Engine according to claim 1, wherein plural ones of said rotary valves lie on the same plane.

7. Engine according to claim 1, wherein said rotary valves of each annular cylinder are arranged spaced about the annular cylinder at the same angle to one another.

8. Engine according to claim 1, wherein cylinder recesses for said intake channel openings into intake compression chambers are located in the direction of rotation of said pistons following rotary valves and said overflow channel outlet openings are located in front of rotary valves.

9. Engine according to claim 1, wherein cylinder recesses for said exhaust channel openings are located in the direction of rotation of said pistons in front of rotary valves and for said overflow channel inlet openings into expansion chambers are located in the direction of rotation following rotary valves.

10. Engine according to claim 1, wherein said rotating pistons are made somewhat longer than the distance between said overflow channel outlet opening and said overflow channel inlet opening.

11. Engine according to claim 1, wherein said rotating pistons of each annular cylinder are located about the annular cylinder at the same angle to one another.

12. Engine according to claim 1, wherein said cylinder chambers in each annular cylinder are located about the annular chamber at the same angle to one another.

13. Engine according to claim 1, wherein the number of cylinder chambers, pistons and rotary valves in each annular cylinder is the same.

14. Engine according to claim 1, wherein ignition devices are located in said overflow channel following a rotating valve in direction of rotation of said pistons.

15. Engine according to claim 1, wherein said rotating pistons do not have piston rings for sealing.

16. Engine according to claim 1, wherein said rotating pistons are made as gas pressure labyrinth pistons with a center hole and choke points.

17. Engine according to claim 1, where said rotor disk is attached torsionally strong on said driven shaft and peripherally penetrates into a slot at a point which fits into a cylinder wall of said annular cylinder.

18. Engine according to claim 1, wherein said rotor disk is made hemispherical.

19. Engine according to claim 1, wherein said rotor disk on any plane of the outside wall of annular cylinder fits into a cylinder wall thereof.

20. Engine according to claim 1, wherein said rotary valves are mechanically joined with a defined transmission ratio and are directly or indirectly driven by said one shaft or rotor disk.

21. Engine according to claim 1, wherein two identical rotary valves are arranged parallel to one another as rotary valve ring disks and are made to turn opposite one another as a rotary valve pair.

22. Engine according to claim 1, wherein there are several annular cylinders along said one shaft in succession.

23. Engine according to claim 1, further comprising an injection device for water injection.

24. Engine according to claim 1, wherein cylinder recesses for said intake channel opening into said expansion chambers are located in a direction of rotation of said pistons following rotary valves.

25. Engine according to claim 1, wherein cylinder recesses for said exhaust channel openings are located in a direction of rotation of said pistons in front of rotary valves.

* * * * *